United States Patent [19]
Ehata et al.
[11] 4,169,239
[45] Sep. 25, 1979

[54] ELECTROSTATICALLY FOCUSING TYPE IMAGE PICKUP TUBES AND METHOD OF MANUFACTURING THE SAME

[75] Inventors: Shigeru Ehata; Hideyuki Sakai; Kinjir Gunbe, all of Mobara, Japan

[73] Assignee: Hitachi, Ltd., Tokyo, Japan

[21] Appl. No.: 818,401

[22] Filed: Jul. 25, 1977

Related U.S. Application Data

[62] Division of Ser. No. 598,012, Jul. 22, 1975, abandoned.

[30] Foreign Application Priority Data

Jul. 26, 1974 [JP] Japan ..... 49-85140

[51] Int. Cl.² ..... H01J 29/46; H01J 29/56

[52] U.S. Cl. ..... 315/16; 313/389; 313/460; 250/213 VT

[58] Field of Search ..... 315/10, 15, 16; 313/449, 460, 389; 250/213 VT

[56] References Cited

U.S. PATENT DOCUMENTS 3,364,372 1/1968 Bennett ..... 313/85

*Primary Examiner*—Theodore M. Blum
*Attorney, Agent, or Firm*—Charles E. Pfund

[57] ABSTRACT

The electron lens of an electrostatically focusing type image pickup tube comprises three coaxially arranged cylindrical electrodes and the inner diameters thereof are decreased from the side of a target toward an electron gun. The electron lens is assembled by successively fitting the three electrodes over a mandrel, the outer diameter thereof varying stepwisely in accordance with the inner diameters of the three electrodes, and then interconnecting the three electrodes by axially extending insulating supporting rods.

13 Claims, 13 Drawing Figures

ELECTROSTATICALLY FOCUSING TYPE IMAGE PICKUP TUBES AND METHOD OF MANUFACTURING THE SAME

This is a division, of co-pending application Ser. No. 598,012 filed July 22, 1975 now abandoned.

BACKGROUND OF THE INVENTION

This invention relates to an electrostatically focusing type image pickup tube and more particularly to a photoconductive electrostatically focusing type image pickup tube.

Since the resolution characteristic of an image pickup tube is influenced greatly by the quality of the electron lens system it is necessary to carefully design the electrode construction of the electron lens system so as to obtain satisfactory operating characteristics and to make easy the method of manufacturing. Generally speaking, in order to obtain a high resolution, it is necessary to focus the electron beam radiated from the cathode electrode of an image pickup tube such that the electron beam will have a cross-sectional configuration of a circle hving a diameter of from 10 to 30 microns, and cause it to impinge upon the target, For this reason, in an electrostatically focusing type image pickup tube, the electrode group comprising the electron lens system is positioned as close as possible to the inner surface of the tube so as to increase as far as possible the diameter of the focusing lens for the purpose of improving the resolution.

FIG. 1 shows a diagrammatic longitudinal sectional view of one example of a prior art electrostatically focusing type image pickup tube having a diameter larger than one inch. The image pickup tube shown in FIG. 1 comprises a cylindrical bulb 1, a target 2 mounted on one end of the bulf and including a face plate, a transparent conductive film, a photoconductive film, and an output terminal (not shown), a stem 4 mounted on the other end of the bulb and provided with a plurality of lead pins 3 and a plurality of electrodes contained in the bulb. The electrodes are arranged coaxially as will be described later in detail. The interior of the bulb 1 is evacuated to a high vacuum. These electrodes comprise a getter 5, a cathode electrode 6, a first grid electrode 7, and a second grid electrode 8. An apertured electrode 8*a* having a small perforation for passing an electron beam is secured to one side of the second grid electrode which faces target 2, the perforation serving to restrict the electon beam emanated from the cathode electrode 6 for producing a fine beam. The cathode electrode 6 and the first and second grid electrodes 7 and 8 cooperate to constitute a three electrode electron gun structure. There are also provided a cylindrical third grid electrode 9 having a reduced diameter portion on its side facing the cathode electrode 6, a cylindrical fourth grid electrode 10 having reduced diameter portions on both ends, and a cylindrical fifth grid electrode 11. The third and fifth grid electrodes 9 and 11 are arranged to overlap the reduced diameter portions of the fourth grid electrode 10 and these three grid electrodes are supported by a plurality of insulating supporting rods 12 (only two are shown) mounted on thin outer peripheries. These three grid electrodes constitute an electrostatic electron lens structure for focusing the electron beam from the three electrode electron gun structure and to cause the focused electron beam to impinge upon the target 2. A mesh electrode 13 is interposed between the fifth grid electrode 11 and the target 2.

In an image pickup tube constructed as above described there are problems in the method of securing the third, fourth and fifth grid electrodes 9, 10 and 11. More particularly, it is difficult to coaxially arrange at high accuracies the third, fourth and fifth grid electrodes 9, 10 and 11 having constructions described above. Thus, since the third and fifth grid electrodes 9 and 11 are arranged on both sides of the fourth grid electrode 10 having reduced diameter portions on both ends. For this reason, it is necessary to divide into two sections the mandrel adapted to support the three grid electrodes in the assembled condition. For example, a first cylindrical mandrel, not shown, having a diameter substantially equal to the reduced diameter portions on both ends of the fourth grid electrode 10 is inserted into the three grid electrodes and then second cylindrical spacers, not shown, having outer diameters substantially equal to the inner diameters of the third and fifth grid electrodes 9 and 11, respectively, are inserted between the first mandrel and the third grid electrode 9 and between the first mandrel and the fifth grid electrode 11, respectively, thereby holding the three grid electrodes in the assembled condition. Thereafter, a plurality of insulating supporting rods 12 are disposed on the outer surfaces of respective grid electrodes and the grid electrodes and the supporting rods are clamped together by U shaped straps.

With this method of assembling the grid electrodes as the constructions of the mandrels are complicated it is difficult to assemble the grid electrodes at high accuracies. Moreover, as the mandrels are withdrawn after assembling the grid electrodes are often deformed with the result that the grid electrodes become eccentric with each other or their axes become out of alignment. Further, when the clamping straps are welded to respective grid electrodes, as the mandrels are used as one welding electrode the surface of the mandrels is impaired thus decreasing the accuracy of assembling. The warping of the insulating supporting rods also decreases the accuracy of assembling. In the electrostatically focusing type image pickup tube having a diameter more than one inch the resolution of the image pickup tube is degraded due to the deformation of the component parts or eccentric relation among various electrodes which are generated during the assembling of the electrodes that constitute the electrostatic electron lens structure.

On the other hand, in an image pickup tube having a diameter of less than one inch, as it is necessary to increase as far as possible the diameter of the electrostatic focusing lens more careful consideration should be made for the construction and the method of assembling the electrodes. In this case too, there is a problem of degrading the resolution.

FIG. 2 is a diagrammatic longitudinal sectional view showing one example of a small size prior art electrostatically focusing type image pickup tube having an outer diameter of less than one inch. In FIG. 2 elements corresponding to those shown in FIG. 1 are designated by the same reference numerals. The tube shown in FIG. 2 comprises a cylindrical third grid electrode 14 having a reduced diameter portion on one end thereof facing the cathode electrode and fourth and fifth cylindrical grid electrodes 15 and 16 each having the same inner diameter as that of the other end of the third grid electrode 14 facing the target 2. These three grid electrodes are coaxially arranged by means of a plurality of insulating supporting rods 12 to constitute an electrostatic electron lens structure. The image pickup tube shown in FIG. 2 is different from that shown in FIG. 1 in that the fourth grid electrode 15 is not provided with reduced diameter portions on the opposite ends thereof.

The method of assembling the third, fourth and fifth grid electrodes will now be described. Thus, a mandrel 17 having an outer diameter substantially equal to those of the respective grid electrodes is inserted through these grid electrodes after arranging them coaxially. The grid electrodes are spaced from each other by predetermined spacings by using spacers or the like. Thereafter, insulating supporting rods are placed on the outer periphery of respective grid electrodes and then clamping straps 18 embracing the insulating supporting rods 12 are welded to respective grid electrodes. Similar to the image pickup tube shown in FIG. 1, in the case shown in FIG. 2 too there are many problems including the damage of the surface of the mandrel, warping of the insulating supporting rods, and deformation of the ends of respective grid electrodes which are caused by the heat of welding, and the deformation of respective grid electrodes caused by the removal of the mandrel, whereby it is difficult to sufficiently improve the accuracy of assembling.

Comparing the electrode construction shown in FIG. 1 wherein the ends of respective electrodes are overlapped with the electrode construction shown in FIG. 2 wherein all grid electrodes have the same inner diameter, the latter electrode construction is advantageous in that it is possible to assemble the electrodes by using a single mandrel thereby preventing the decrease in the accuracy caused by the use of mandrels having complicated construction. However, as three grid electrodes are arranged coaxially with thin ends faced with each other the cylindrical members that constitute the third, fourth and fifth grid electrodes should be true circles. In the image pickup tubes having constructions as above described departure of the periphery of the electrodes from a true circle or the deformation of the ends of the grid electrodes greatly degrades the resolution characteristics of the image pickup tube as shown by FIG. 4 in which the abscissa represents the amount of deformation of the grid electrode and the ordinate the ratio of deformation of the grid electrode where 100% represents a condition of no deformation.

In the case of the electrode construction shown in FIG. 1 the effect of the departure from the true circle and deformation upon the resolution can be aleviated by the superposed arrangement of the ends of the third, fourth and fifth grid electrods 9, 10 and 11. However the diameter of the focusing lens is smaller than that of the latter electrode construction by about 15% to 20%. For example, where the former electrode construction is adopted for an image pickup tube having an outer diameter of ⅔ inch it is necessary to set the inner diameter of the third and fifth grid electrodes to be about 12 mm, and to set the inner diameter of the reduced diameter portions on both ends of the fourth grid electrode to be from 9.5 to 10.5 mm. By a calculation it was found that the diameter of the electron beam on the imaginary surface of the focusing lens is about 2 mm where OV is applied to the first grid electrode and where the cathode current is maximum. In case of typical operating condition, the diameter of the electron beam is about one half of this value, that is from 1.0 to 1.2 mm. But if the diameter of the electron lens were from 9.5 to 10.5 mm, the diameter of the electron beam would be about 10% of the lens diameter. This means that focusing action is liable to be affected by the spherical aberration of the focusing lens thus greatly increasing the diameter of the electron beam impinging upon the target surface. For this reason, whether the assembling accuracy is high or low the resolution of the image pickup tube decreases as the diameter of the focusing lens decreases. FIG. 5 is a plot showing the variation of the resolution as the inner diameter of the fourth grid electrode is varied from 12 mm to 9.5 mm while maintaining the inner diameters of the third and fifth grid electrodes at a constant value of 12 mm, in which the abscissa represents the inner diameter of the fourth grid electrode whereas the ordinate represents the ratio of resolution. As can be noted from FIG. 5, the resolution decreases with the decrease in the inner diameter of the fourth grid electrode. When the inner diameter decreases below 10 mm, the resolution rapidly decreases due to the influence of the spherical aberration and the deformation of the grid electrode. Although decreasing the electron beam diameter on the plane of the focusing lens is effective to prevent the degradation of the resolution caused by the decrease in the diameter of the focusing lens it is necessary to decrease the diameter of the perforation of the apertured electrode provided for the second grid electrode to about 20μ from a normal value of from 20μ to 40μ. However when the throttling rate is increased in this manner the current density of the electron beam drawn from the cathode electrode will be increased by a factor of two or more, thereby greatly decreasing the so-called emission life of the image pickup tube.

SUMMARY OF THE INVENTION

Accordingly, it is an object of this invention to provide a nove electrostatically focusing type image pickup tube having higher resolution than prior art image pickup tubes.

Another object of this invention is to provide a novel electrostatically focusing type image pickup tube having an improved electron lens.

Still another object of this invention is to provide an electrostatically focusing type image pickup tube having an improved electron lens which is easy to assemble.

Yet another object of this invention is to provide an improved electrostatically focusing type image pickup tube having an electron lens which is free from departure from the true circle of the electrode end, and eccentric arrangements of the electrodes as well as the inclination of the axes of the electrodes.

A further object of this invention is to provide an improved electrostatically focusing type image pickup tube capable of increasing the diameter of the electron lens more than the prior art balanced type unipotential lens.

Still further object of this invention is to provide an improved electrostatically focusing type image pickup tube having an electron lens constructed such that the warping or bending of the supporting rods of the electrodes does not apply any unbalanced force to the electrodes.

Another object of this invention is to provide an improved electrostatically focusing type image pickup tube capable of improving the resolution without decreasing the emission life.

Another object of this invention is to provide a novel electrostatically focusing type image pickup tube capable of preventing the decrease in the resolution at the peripheral portion of the tube caused by the increase of the area of the electron beam with reference to the diameter of the focusing electron lens.

Another object of this invention is to provide a novel electrostatically focusing type image pickup tube in which the degradation of the resolution is small.

Another object of this invention is to provide an improved electrostatically novel type image pickup tube capable of preventing variation of the diverging angle of the electron beam travelling toward the target which is caused by the variation in the degree of vacuum.

Another object of this invention is to provide a method of manufacturing an electrostatically focusing type image pickup tube which enables easy assembling of the electron lens.

Another object of this invention is to provide a novel method of manufacturing an electrostatically focusing type image pickup tube capable of preventing deformation of the electrodes when a mandrel utilized for assembling the electron lens is removed from the assembly.

Yet another object of this invention is to provide a novel method of manufacturing an electrostatically focusing type image pickup tube which is not required to use the mandrel as a welding electrode and which can prevent the decrease in the accuracy of assembling caused by the damage of the surface of the mandrel.

According to one aspect of this invention there is provided an electrostatically focusing type image pickup tube of the type comprising an electron gun, an electron lens made up of a plurality of cylindrical electrodes, and a target which are arranged in the order mentioned, characterized in that the electron lens comprises three coaxial cylindrical electrodes and that the inner diameters of the cylindrical electrodes decrease from the target side toward the electron gun side.

According to another aspect of this invention there is provided a method of manufacturing an electrostatically focusing type image pickup tube of the type including an electron gun, an electron lens assembly made up of three cylindrical electrodes, and a target electrode which are arranged in the order mentioned, characterized in that the three cylindrical electrodes are prepared such that thin inner diameters decrease from the target toward the electron gun, that a cylindrical mandrel is prepared, that the outer diameter of the mandrel is varied stepwisely according to the inner diameters of the three electrodes, that the three electrodes are successively fitted over the mandrel, and that the three electrodes are interconnected by a plurality of insulating and supporting rods which are spaced apart each other in the circumferential direction of the electrodes.

In a preferred embodiment of this invention, the electron gun assembly is made up of a cathode electrode, first and second grid electrodes and an apertured electrode for passing an electron beam, the electron lens assembly is made up of cylindrical third, fourth and fifth grid electrodes, a mesh electrode is disposed between the electron lens assembly and the target, and wherein a first voltage is impressed upon the second and fifth grid electrodes, a second voltage which is higher than the first voltage is impressed upon the third grid electrode and the mesh electrode, and a third voltage which is lower than the first and second voltages is impressed upon the fourth grid electrode.

The adjacent ends of the third, fourth and fifth grid electrodes are overlapped each other with a predetermined radial gap therebetween.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 1:
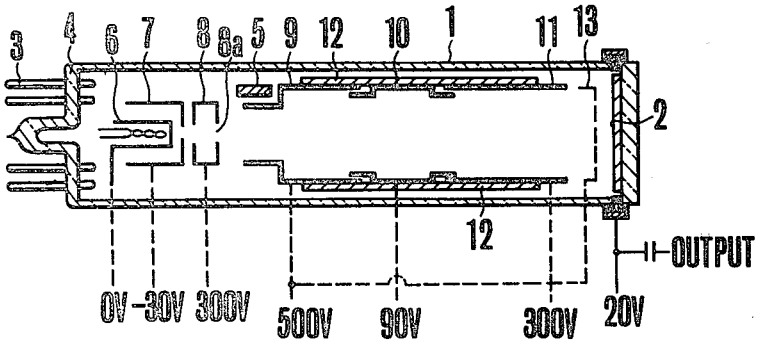
FIG.1 PRIOR ART
FIGS. 1 and 2 are diagrammatic longitudinal sectional views of two examples of the prior art electrostatically focusing type image pickup tubes.
Figure 2:
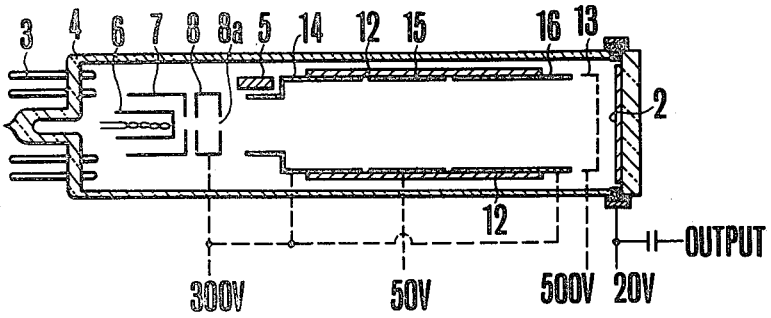
FIG.2 PRIOR ART
Figure 3:
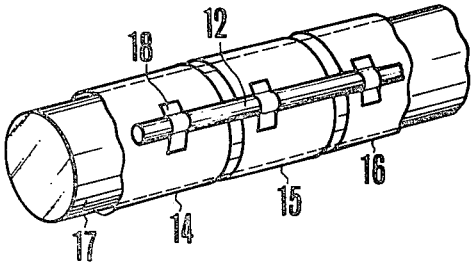
FIG.3 PRIOR ART
FIG. 3 is a perspective view showing one example of the method of assembling the focusing lens utilized in the image pickup tube shown in FIG. 2.
Figure 6:
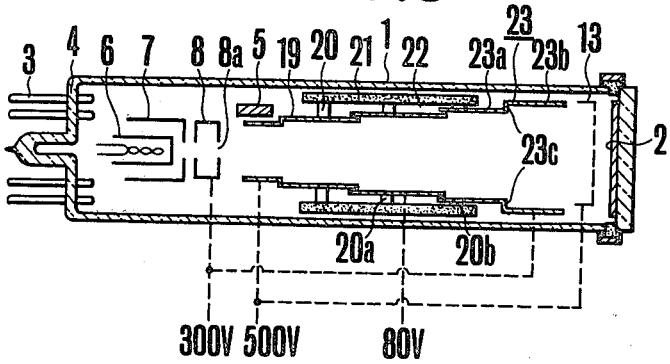
FIG. 6 is a diagrammatic longitudinal sectional view of one example of the electrostatically focusing type image pickup tube embodying the invention.

FIG. 6 shows a diagrammatic longitudinal sectional view of one embodiment of this invention in which elements corresponding to those shown in FIGS. 1 or 2 are designated by the same reference numerals. As shown, a third grid electrode 19 has a cylindrical form having a reduced diameter portion at one end thereof facing the cathode electrode 6. The grid electrode 19 is secured to a plurality of insulating supporting rods 21 made of glass, for example, through a plurality of supports or tabs 20 secured to the outer surface of the third grid electrode 19. A cylindrical fourth grid electrode 22 is arranged coaxially with the third grid electrode 19 with its one end overlapped on one end of the third grid electrode with a predetermined gap therebetween. The fourth grid electrode 22 is designed to have an inner diameter slightly larger than the outer diameter of the third grid electrode 19. The fourth grid electrode 22 is secured to insulating supporting rods 21 by inserting radially projecting supports 20*a* into the supporting rods 21 and then welding thereto, the supports 20*a* being secured to the outer surface of the fourth grid electrode 22 and being aligned in the axial direction with said supports 20. The fifth grid electrode 23 comprises a smaller cylindrical section 23*a* having an inner diameter slightly larger than the outer diameter of the fourth grid electrode 22 and a larger cylindrical section 23*b* having an inner diameter slightly larger than the outer diameter of section 23*a*. The smaller section 23*a* is positioned on the side of the cathode electrode 6 whereas the larger section 23*b* is positioned on the side of the target 2, and these two sections are constructed to have equal axial length. The end of the smaller section on the side of the cathode electrode 6 overlaps one end of the fourth grid electrode 22 with a predetermined radial gap. The smaller section 23*a* is secured to the insulating supporting rod 21 through supports 20*b* projecting in the radial direction. Larger and smaller sections 23*b* and 23*a* of the fifth grid electrode 23 are connected together through an annular shoulder 23*c* provided for one of them. The coaxially arranged third, fourth and fifth grid electrodes 19, 22 and 23 have inner diameters increasing in the order mentioned. In other words, the fifth grid electrode 23 positioned close to the target 2 has the largest inner diameter and the third grid electrode on the side of the cathode electrode 6 has the smallest inner diameter. Supports 20, 20*a* and 20*b* are formed to have larger length as the diameters of the third, fourth and fifth grid electrodes decrease progressively. Consequently, it is possible to secure the insulating supporting rods 21 to respective grid electrodes while maintaining the insulating rods in parallel with the axis of the tube.

Figure 4:
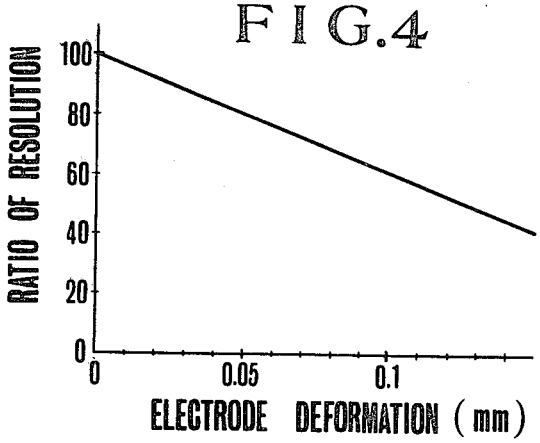
FIGS. 4 and 5 are graphs showing certain characteristics of the prior art image pickup tube.
Figure 5:
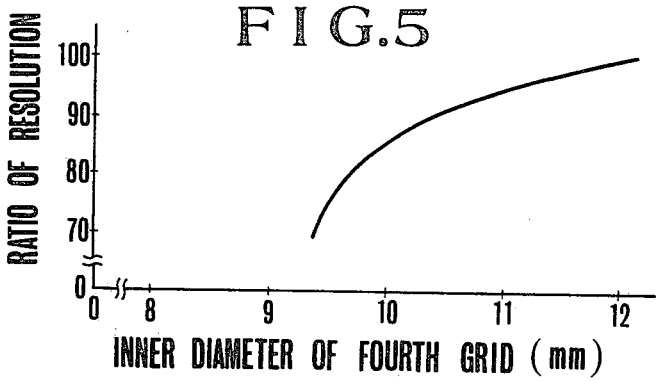

The detail of the construction of respective grid electrodes will now be described with reference to a specific image pickup tube having an outer diameter of $\frac{2}{3}$ inch. In this case, bulb 1 has an inner diameter of 16 mm, and the inner diameter of the righthand end of the third grid electrode 19 on the side of the target 2, that of the fourth grid electrode 22, those of the smaller section 23*a* and larger section 23*b* of the fifth grid electrode 23 are selected to be respectively within ranges of 8.5–9.9 mm, 9.5–10.9 mm, 10.5–11.9 mm and 11.0–12.3 mm. Further, the third, fourth and fifth grid electrodes are arranged such that radial gaps of from 0.3 to 1 mm are formed between their overlapped ends and that thin ends overlap each other in the axial direction over a distance of 0.5–2 mm. Although it is possible to make the radial gaps to be less than 0.3 mm or to be larger than 1.0 mm, if the radial gap is selected to be less than 0.3 mm, it would be necessary to work respective grid electrodes and the mandrel utilized to assemble them at higher accuracies than those required to finish them to obtain practical resolution, for example to obtain a center resolution of more than 550 TV lines in a $\frac{2}{3}$ inch image pickup tube. Otherwise, it would be impossible to mutually insulate respective grid electrodes. Such high accuracies increase the cost of manufacturing and render it impossible to produce the image pickup tubes by mass production technique. Where the radial gap is selected to be larger than 1 mm, it is impossible to form an electron lens having a diameter necessary to obtain a practical resolution as shown by the resolution characteristic shown in FIG. 5. Similarly, it is possible to make the axially overlapping length to be less than 0.5 mm or larger than 2 mm, if the length were set to be less than 0.5 mm the result of experiment shows that the amount of deformation of the third, fourth and fifth grid electrodes and the degradation of the resolution characteristic are substantially the same as that shown in FIG. 4 whereby the advantage of the electrode construction shown in FIG. 6 would be lost. Since the overall length of the image pickup tube is normally equal to 105 mm for $\frac{2}{3}$ inch tubes and to 160 mm for 1 inch tubes the axial lengths of the respective grid electrodes will be nearly constant in a range of usually employed beam focusing voltage (the voltage impressed upon the fourth grid voltage), that is from 40 to 100V. Under these conditions, if respective grid electrodes were overlapped in the axial direction for a length of more than 2 mm, the position of the electron lens would be shifted closer to the target than is required so that when the image pickup tube is combined with a conventional coil assembly utilized to deflect the electron beam, the electron lens will be included in the region of the deflection magnetic field. Accordingly, the electron beam is deflected by the magnetic field within the electron lens with the result that the electron beam directed to the periphery region on the target which is to be scanned by the electron beam will be greatly deformed to depart from a true circle due to aberration. Moreover, as the diameter of the electron beam on the target surface is increased the resolution on the periphery of the reproduced picture is degraded. Such phenomenon can be proven by calculation and experiment.

In this case, where the voltages impressed upon the third and fifth grid electrodes are selected to conventional values, for example 500V and 300V, respectively or 300V for both grid electrodes, it is necessary to set the focusing voltage (the voltage impressed upon the fourth grid electrode) to be less than the conventional value for the purpose of focusing the electron beam on the target surface under the best condition. As a consequence, the gradient of the electric field constituting the electron lens becomes very steep and the electron beam becomes more susceptible to the adverse effect of the aberration thereby degrading resolution. Where the amounts of deformation and eccentricity are smaller than the levels resulting from ordinary steps of manufacturing of the electrodes of an image pickup tube, that is less than 0.1 mm, even when the axial overlapping length is increased beyond the value mentioned above, such increase does not constitute to the improvement of resolution.

The plurality of radial supports 20, 20*a* and 20*b* which are secured to the outer peripheries of respective grid electrodes 19, 22 and 23 are disposed at a spacing of 180°, 120° or 90°. The positions of these supports should be determined by taking into consideration such factors as the overlapped construction of the ends of the electrodes, the mechanical strength between the insulating supporting rods and respective grid electrodes and the accuracy of assembling the grid electrodes.

Figure 7:
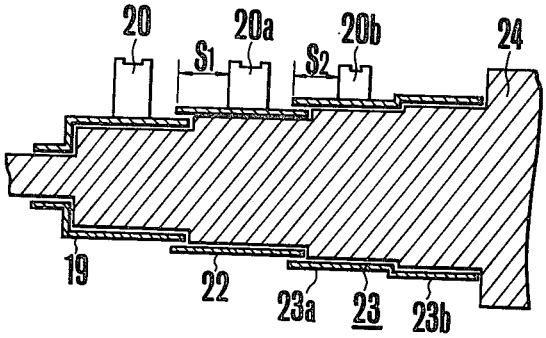
FIG. 7 is a sectional view showing the relative position of the supports of the focusing lens utilized in the image pickup tube embodying the invention.

FIG. 7 is a partial sectional view utilized to show the mounting positions of respective supports. As shown, the third, fourth and fifth grid electrodes are fitted over a mandrel 24 having stepwisely decreasing diameters. When assembling the respective electrodes in this manner, unless the spacings $S_1$ and $S_2$ between the supports 20*a* and the lefthand end of the fourth grid electrode 22 and between the supports 20*b* for the fifth grid electrode 23 and the lefthand end thereof are respectively set above at least 3 mm it was found by experiment that it is impossible to maintain respective grid electrodes in the form of true circles.

Figure 8:
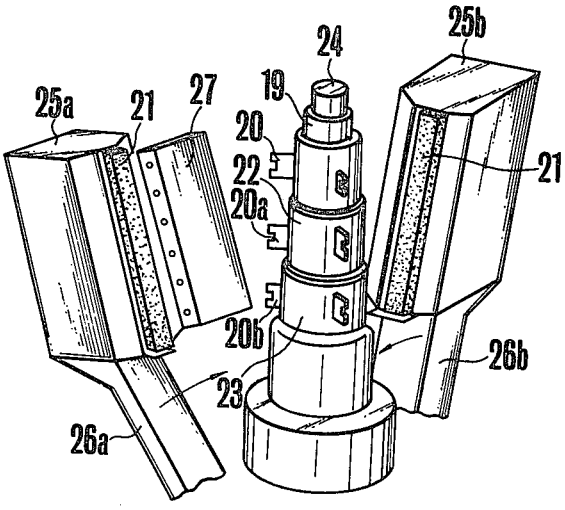
FIG. 8 is a simplified perspective view showing the method of assembling the focusing lens of the image pickup tube embodying the invention.

The method of securing the respective grid electrodes provided with supports in a manner described above to the insulating supporting rods will now be described with reference to FIGS. 7 and 8. FIG. 8 shows one example of apparatus utilized to fabricate the electrode structure of this invention. A mandrel 24 whose diameter increases stepwisely as shown in FIG. 7 is used and the fifth, fourth and third grid electrodes 23, 22 and 19 having increased diameters in the order mentioned are fitted over the mandrel starting from the fifth grid electrode 23 having the largest diameter. It is to be understood that the diameters of various sections of the mandrel 24 are selected such that respective grid electrodes are arranged in predetermined axial and radial positions. With this mandrel it is not necessary to use any spacers which have been used to determine the spacings between respective grid electrodes when the electrodes are assembled according to the prior art method. Bases 25*a* and 25*b* are mounted about the mandrel 24 at a predetermined spacing. These bases are used to support the insulating supporting rods 21 made of glass. Due to the limitations imposed by the dimensions of the respective grid electrodes and by the inner diameter of the bulb the cross-sectional configuration of the rods 21 is made to be eliptical having a minor radius of about 1.5 mm and the major radius of about 4 mm or to be rectangular having a width of about 4 mm. This construction gives an electrode structure having a sufficiently large mechanical strength. Bases 25*a* and 25*b* are mounted on arms 26*a* and 26*b* which are rotatable toward the mandrel 24 as shown by arrows so as to press insulating supporting rods 21 against respective supports 20, 20*a* and 20*b* of respective grid electrodes. Although not shown in FIG. 8, arms 26*a* and 26*b* are pivotally mounted on a pivot pin on the axis of the mandrel 24. A pair of burners 27 (only one is shown) are arranged on both sides of each insulating supporting rod 21 so that when the bases are rotated toward the mandrel 24, respective rods 21 are heated by the flames of the gas ejected from the burners 27. When the glass rods 21 are softened the supply of the gas to the burners 27 is stopped. Then the bases 25*a* and 25*b* are rotated toward the mandrel 24 by the arms 26*a* and 26*b* to urge the fused glass rods against the supports 20, 20*a* and 20*b* of respective grid electrodes. This condition is maintained for a while until the glass rods 21 cool below about 200° C. Then the bases 25*a* and 25*b* are returned to the original position. In a small image pickup tube having a diameter of ⅜ inch, since the volume of the glass rods is small, they tend to cool before they are urged against the supports. For this reason, if the viscosity of the fused glass rods is low the accuracy of assembling the electrodes would be decreased due to the shock created at the time of engagement. In an extreme case, the glass rods would be broken. Where the glass rods are excessively fused by the gas flames the glass rods will deform with the result that the maximum outer diameter of the assembled grid electrodes may become larger than the inner diameter of the bulb thus making it impossible to insert the electrode assembly into the bulb. Or due to the fusion of the glass rods to the bases, the respective grid electrodes will be deformed by the tension applied thereto which is created when the bases are returned to the original positions, whereby the electrodes are deformed. Thus, their configurations will depart from true circles to an unpermissible extent. In an extreme case, the glass rods will be broken. To obviate these difficulties, it is necessary to control the temperature of the glass rods and hence the bases 25*a* and 25*b* to be within a range of from 650° to 700° C. and to maintain the temperature difference between the bases 25*a* and 25*b* to be less than 30° C. Moreover, it is necessary to control the difference between the instants at which the glass rods are urged against respective supports 20, 20*a* and 20*b* to be less than 0.1 second and to control the difference between the pressures under which the glass rods are urged against respective supports to be less than 0.5 kg. Unless these conditions are satisfied it was found that it is impossible to maintain the accuracy within the practical limits.

Figure 9:
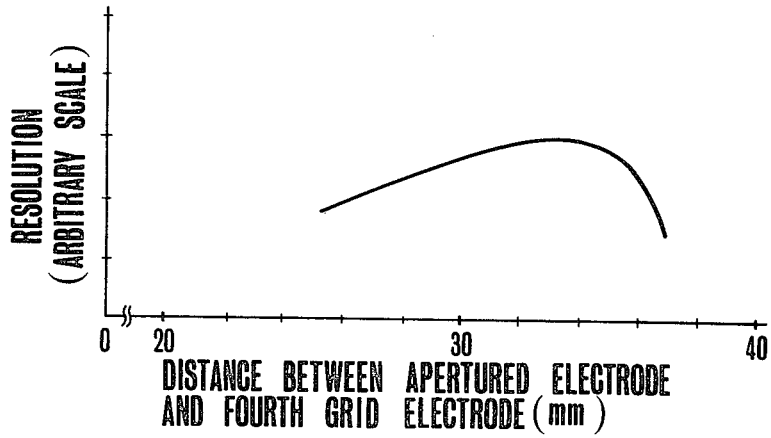
FIG. 9 is a graph showing one example of the characteristic of the present image pickup tube.

In a ⅜ inch image pickup tube employing an electrode structure as shown in FIG. 6, for the purpose of improving the resolution, the third, fourth and fifth grid electrodes should have as far as possible large diameters. However, if the inner diameters of the grid electrodes exceed the dimensions described above it becomes obligatory to make thin the glass rods. However, such thin glass rods cannot withstand the mechanical shocks created during the assembling steps thus limiting the handling of the component parts of the image pickup tube. In the ⅜ inch image pickup tube described above, when the inner diameter of the righthand end of the third grid electrode 19 (FIG. 6) and that of the smaller section 23*a* of the fifth grid electrode 23 are compared with the inner diameter of the third grid 14 shown in FIG. 2 and that of the fifth grid diameter 16, the diameters of this embodiment of this invention are smaller by 3 mm and 2 mm respectively. However, since the image pickup tube incorporating this embodiment has the following merits it is possible to decrease the diameters of the third, fourth and fifth grid electrodes 19, 22 and 23 that comprise the focusing lens. Firstly, since the adjacent ends of respective grid electrodes overlap each other in the axial direction, the deformations at the ends of the electrodes are greatly decreased. Secondly, three grid electrodes are arranged as desired by simultaneously urging fused insulating supporting rods 21 utilized to fixedly secure respectively grid electrodes against the supports 20, 20*a* and 20*b* under prescribed manufacturing conditions so that substantially the same forces are applied to respective grid electrodes thus solving the problem of decreasing the accuracy due to the bending or warping of the insulating supporting rods. Thirdly, since the mandrel adapted to arrange and support three grid electrodes has a stepped construction, it is possible to readily remove the mandrel from the assembled electrode thereby decreasing the deformation thereof. Further, as the mandrel is not used as a welding electrode, decrease in the accuracy caused by the damage of the mandrel surface can be prevented. Where the fourth grid electrode 22 is arranged with its mechanical center spaced from the apertured electrode 8*a* by 25 to 35 mm the resolution at the periphery of the reproduced picture has a characteristic as shown in FIG. 9. For this reason, it is possible to make the focusing lens to have sufficiently large diameter with respect to the diameter of the electron beam. In FIG. 9 the abscissa represents the distance between the apertured electrode and the fourth grid electrode and the ordinate the resolution in an arbitrary scale. Fourthly, it is possible to locate the apertured electrode 8*a* at a position 2 to 4 mm spaced from the top of the cathode electrode 6 to make the diameter of the perforation to be in the ordinary range of 30 to 40 microns. This prevents decrease in the resolution on the periphery of the picture which is caused by the increase in the cross-sectional area of the electron beam with respect to the diameter of the focusing lens. Moreover, as it is not necessary to make small the perforation it is possible to increase the emission life.

Other advantages of the electrostatically focusing type image pickup tube embodying the invention are as follows. Referring again to FIG. 6, a voltage of OV is impressed upon the cathode electrode 6 through lead pins 3 extending through the stem 4, approximately 30V is impressed upon the first grid electrode 7, 300V is applied to the second and fifth grid electrodes 8 and 23 which are interconnected within the envelope, 500V is impressed upon the third grid electrode 19 and the mesh electrode 13 which are also interconnected by a conductor within the envelope and about 80V is impressed upon the fourth grid electrode 22. The interconnections between the second and fifth grid electrodes and between the third grid electrode and the mesh electrode can also be made on the outside of the envelope through lead pins 3. However, in a small pickup tube having a diameter of ⅔ inch, for example, as the number of lead pins 3 is generally 7 it is necessary to interconnect the electrons on the outside of the tube. To impress voltages as described above either the second and fifth grid electrodes or the third grid electrode and the mesh electrode must be interconnected on the outside of the tube. Such operating voltages are well known only for the image pickup tubes shown in FIG. 1 and having outer diameters exceeding one inch. If such operating voltages are applied to an image pickup tube of this invention shown in FIG. 6, following special advantages can be obtained.

Figure 10:
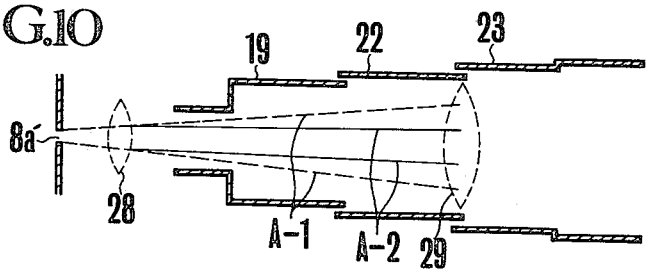
FIG. 10 is a diagrammatic representation to explain the principle of the advantage of the novel image pickup tube embodying the invention and FIGS. 11, 12 and 13 are graphs showing certain advantageous effects of the image pickup tubes of this invention.

More particularly, in a conventional ⅔ inch image pickup tube shown in FIG. 2, the same voltage of 300V is impressed upon the second, third and fifth grid electrodes 8, 14 and 16, 500V upon the mesh electrode 13, and 50V upon the fourth grid electrode 15 for the purpose of forming a focusing lens generally termed as a balanced type unipotential lens between the third, fourth and fifth grid electrodes 14, 15 and 16. With such operating voltages, since the same voltage is impressed upon independent second and fifth grid electrodes 8 and 14, no lens is formed between these grid electrodes. As a consequence, the electrode beam diverges over an angle indicated by broken lines A-I in FIG. 10, and the electron beam is focused only by the main lens formed between the third to fifth grid electrodes. In contrast, with the operating voltages described above, a prefocusing lens 28 is formed between the second and third grid electrodes 8 and 19 as shown in FIG. 10 whereby the electron beam passed through the small aperture of the apertured electrode 8*a* is prefocused and then focused further by the nonbalanced type unipotential lens 29 formed by the third, fourth and fifth grid electrodes. For this reason, it is possible to decrease the angle of divergence to a small angle A-2 indicated by solid lines when the electron beam passes through the third and fourth grid electrodes 19 and 22 having relatively small diameters. This is advantageous because it is possible to make the third and fourth grid electrodes to have small inner diameters. Moreover, in the balanced type unipotential lens shown in FIG. 2 the principal plane of the main lens substantially coincides with the mechanical center of the fourth grid electrode, whereas with the electrode construction of this invention shown in FIG. 6 and with the operating voltages described above, the voltage impressed upon the fifth grid electrode 23 is lower than that impressed upon the third grid 19 so that the principal plane of the non-balanced type unipotential lens 29 will approach toward the fifth grid electrode 23. For this reason, there is another advantages that it is possible to increase the diameter of the main lens more than that of the balanced type unipotential lens corresponding to the distance of approach to the fifth grid electrode.

Figure 11:
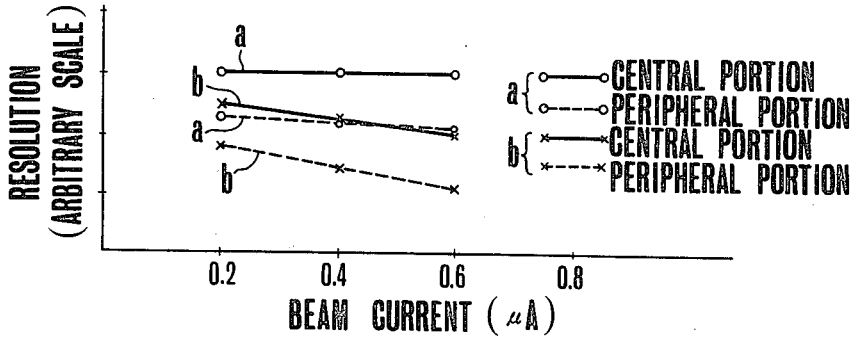

In this manner, by applying a voltage system that forms a nonbalanced type unipotential lens to the image pickup tube of this invention employing an electrode structure having extremely high accuracy of assembling the resolution characteristic of the image pickup tube is improved by about 20% over the conventional pickup tube not only in the central portion but also in the peripheral portion as shown in FIG. 11. Further, even when the beam current is increased, the degradation of the resolution is very small. In FIG. 11, the abscissa represents the beam current and the ordinate the resolution in an arbitrary scale. Solid lines represent the resolution at the central portion whereas the broken lines the resolution in the peripheral portion. The lines denoted by a represent the resolution of the novel image pickup tube of this invention and the lines denoted by b represent that of the prior art image pickup tube.

Figure 12:
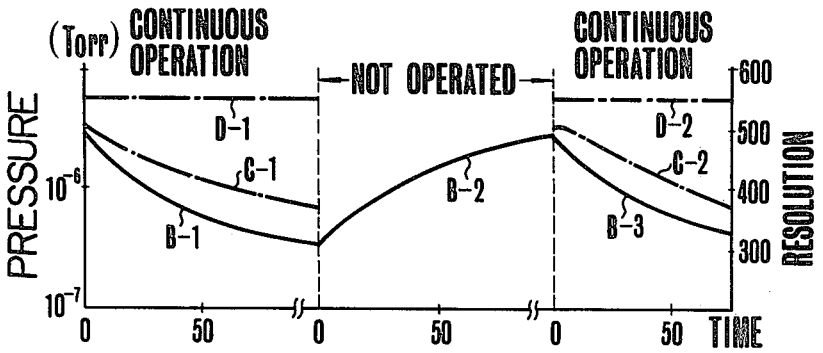

The image pickup tube of this invention has the following additional advantageous features. Although the inside of the bulb is maintained at a high vacuum, due to the operation of a getter it is difficult to always maintain the vacuum at a constant value. More particularly, when the image pickup tube is operated continuously, the degree of vacuum in the bulb gradually increases as shown by a solid curve B-1 in FIG. 12, but when the operation is interrupted the degree of vacuum decreases as shown by curve B-2. When the image pickup tube is operated again, the degree of vacuum again increases gradually as shown by curve B-3. In FIG. 12 the abscissa represents the time and the ordinate the resolution and the degree of vacuum. Such tendency of varying the degree of vacuum is especially remarkable in small size tubes, which is attributable to the following reasons. Firstly, in an image pickup tube of small size, since the grid electrodes are located close to the target made of material not resistant to heat, for example, antimony trisulfide, it is impossible to sufficiently degas the tube by heating the electrodes during the exhaust step. Further, in a small sized image pickup tube, the sputtering area of the getter is narrow. On the other hand, the angle of divergence of the electron beam which has passed through the perforation of the apertured electrode located near the second grid electrode and travelling toward the electron lens formed between the third, fourth and fifth grid electrodes varies with the variation of the degree of vacuum. As a consequence, when the operation of the tube is continued by adjusting the focusing voltage impressed upon the fourth grid electrode such that the electron beam will impinge upon the target at the most suitable condition, the resolution decreases gradually from the best value with the variation of the degree of vacuum as shown by curve C-1 in FIG. 12. When the operation of the image pickup tube is interrupted and then commenced again the resolution restores the original best value with the variation in the degree of vacuum but again decreases as shown by curve C-2 as the operation of the tube is continued further. Such variation of the resolution amounts to 100 to 200 TV lines when the operation is continued for 100 hours, for example. This is not tolerable in the practical use.

If the electrode structure shown in FIG. 6 and the voltage system described above were used, the variation in the angle of divergence of the electron beam passed through the apertured electrode 8*a* can be substantially decreased by the action of the prefocus lens. Moreover, as the magnifying power of the nonbalanced type unipotential lens or the main lens is substantially decreased by the fact that the principal plane of the main lens approaches toward the fifth grid electrode, whereby it is possible to greatly decrease the percentage variation of the image caused by the variation in the angle of divergence by the cummulative action of the decreases in the variation of the angle of divergence and the decrease in the multiplying power. In addition, according to the electrode structure and the voltage system of this invention the asymmetry of the electrodes can be greatly decreased. Further, by the decreases in the prefocus and the multiplying power of the main electron lens the resolution is improved by about 10% over that of the conventional image pickup tube so that even when the voltage impressed upon the fourth grid electrode (focusing voltage) is caused to vary by some external factors it is possible to maintain the resolution within the practical limits.

Figure 13:
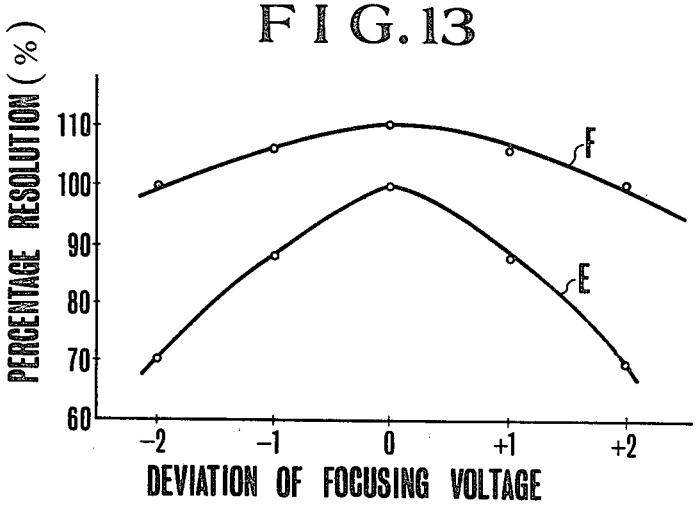

FIG. 13 shows the relationship between the percentage resolution and the deviation of the focusing voltage of the image pickup tube embodying the invention and the prior art image pickup tube in which the abscissa shows the deviation of the focusing voltage and the ordinate the percentage resolution or the variation thereof 100% resolution corresponding to zero deviation of the focusing voltage. Curve E shows the characteristic of the prior art image pickup tube and curve F that of the novel image pickup tube of this invention. For this reason, even when the image pickup tube is operated continuously, the resolution does not vary at all as shown by dot and dash lines D-1 and D-2 in FIG. 12.

It should be understood that the voltage system described in connection with FIG. 6 is only one example. For example, the voltage impressed upon the third grid electrode 19 is not limited to 500V, but any voltages having values larger than that impressed upon the fifth grid electrode 23 may be used.

Although above description relates mainly to an image pickup tube having an outer diameter of $\frac{2}{3}$ inch it will be clear that the electrode construction and the voltage system of this invention can also be applied to image pickup tubes having different diameters. Where the outer diameter is different from $\frac{2}{3}$ inch, the diameters of various electrodes and relative position thereof are varied proportionally. For example, the inner diameter of the third, fourth and fifth grid electrodes may be selected to be respectively in the range of 53–62%, 59–68% and 66–75% of the inner diameter of the bulb. The lengths of the axial overlapping at the ends of respective electrodes, radial dimensions at the overlapped portions, and the mounting positions of the supports may be the same as those of the above described embodiment.

Further, in the foregoing embodiment it was described that the third, fourth and fifth grid electrodes are secured by a plurality of insulating supporting rods, it will be clear that all electrodes including first to fifth grid electrodes and the mesh electrode, or some of them may be secured to the insulating and supporting rods by fusion.

Further instead of composing the fifth grid electrode of two sections having different diameter, the fifth grid electrode may be composed of a single cylinder having a uniform diameter, or a tapered cylinder having a larger opening on the side thereof facing the target. The reason that the diameter of the section 23*b* on the side of the target is made larger as shown in FIG. 6 is to increase the mechanical strength in the radial direction of the grid electrode and to enlarge the range of deflection of the electron beam for decreasing the disportion of the picture image at the peripheral portion thereof. Further, the diameter of the section 23B is enlarged since it is not necessary to support it by the insulating and supporting rods. In other words, these rods are used for the purpose of interconnecting three grid electrodes at a predetermined relative position necessary for constituting an electron lens so that the rods are not required to extend to the end of the fifth grid electrode close to the target.

As has been described hereinabove, in the electrostatic image pickup tube the inner diameters of the third, fourth and fifth grid electrodes are selected to be respectively in the ranges of 53–62%, 59–68% and 66–75% of the inner diameter of the bulb and the diameter of the fourth grid electrode is made smaller than that of the fifth grid electrode. Accordingly, it is possible to greatly improve the accuracy of assembling, and to make easy the manufacturing. As a consequence, the resolution of the image pickup tube is maintained always at a constant high value irrespective of the variations in the degree of vacuum in the bulb and in the focusing voltage.

What is claimed is:

1. An electrostatically focusing type image pickup tube comprising an electron gun assembly made up of a cathode electrode, first and second grid electrodes and an apertured electrode for passing an electrode beam; an electron lens assembly made up of cylindrical third, fourth and fifth grid electrodes; a target including a transparent conductive film and a photoconductive film; a mesh electrode located between said electron lens assembly and said target; and a cylindrically envelope containing above described elements, wherein the inner diameter of said fourth grid electrode is smaller than that of said fifth grid electrode, and the inner diameter of said third grid electrode is smaller than that of said fourth grid electrode, means for impressing a first voltage upon said second and fifth grid electrodes, means for impressing a second voltage which is higher than said first voltage upon said third grid electrode and said mesh electrode and means for applying a third voltage which is lower than said first and second voltages upon said fourth grid electrode.

2. The image pickup tube according to claim 1 wherein the adjacent ends of said third and fourth grid electrodes overlap each other, the adjacent ends of said fourth and fifth grid electrodes overlap each other, and the inner diameters of said third, fourth and fifth grid electrodes are determined to satisfy following equations.

$$0.53D \leqq d_3 \leqq 0.62D$$

$$0.59D \leqq d_4 \leqq 0.68D$$

$$0.66D \leqq d_5 \leqq 0.75D$$

wherein $d_3$, $d_4$ and $d_5$ represent the inner diameters of the third, fourth and fifth grid electrodes respectively, and D the inner diameter of said cylindrical envelope.

3. The image pickup tube according to claim 2 wherein said fifth grid electrode comprises two cylindrical sections having different diameters, the smaller section is positioned close to said fourth grid electrode, the larger section is positioned close to the target, and the inner diameter of said larger section is in a range of 69 to 77% of the inner diameter of said envelope.

4. The image pickup tube according to claim 1 wherein the overlapped ends of said third, fourth and fifth grid electrodes are spaced each other in the radial direction by 0.3 to 1 mm.

5. The image pickup tube according to claim 1 wherein the adjacent ends of said third, fourth and fifth grid electrodes overlap each other for an axial length of from 0.5 to 2 mm.

6. The image pickup tube according to claim 1 which further comprises a plurality of radial supports secured to each of said third, fourth and fifth grid electrodes, said supports being arranged on a plurality of axially extending lines, and a plurality of insulating supporting rods connected to the supports on the same axially extending lines.

7. The image pickup tube according to claim 6 wherein each support has an eliptical cross-sectional configuration.

8. The image pickup tube according to claim 6, wherein the supports secured to said fourth and fifth grid electrodes are spaced 3 mm respectively from the ends of the grid electrodes facing the cathode electrode.

9. The image pickup tube according to claim 1 which further comprises means for electrically interconnecting said second and fifth grid electrodes in said envelope.

10. The image pickup tube according to claim 1 which further comprises means for electrically interconnecting said third grid electrode and said mesh electrode in said envelope.

11. The image pickup tube according to claim 1 wherein said first voltage is equal to 300V, said second voltage is equal to 500V, and said third voltage is equal to about 80V, and said image pickup tube further comprises means for impressing 0 volt upon said cathode electrode and means for impressing about 30V upon said first grid electrode.

12. An electrostatically focusing type image pickup tube comprising an electrode gun assembly made up of a cathode electrode, first and second grid electrodes and an apertured electrode for passing an electron beam; an electron lens assembly made up of cylindrical third, fourth and fifth grid electrodes; a target including a face plate, transparent conductive film, and a photoconductive film which are formed on said face plate; a mesh electrode disposed between said electron lens assembly and said target; and a cylindrical envelope containing above-mentioned elements; the inner diameter of said fourth grid electrode being smaller thaw that of the fifth grid electrode, the inner diameter of said third grid electrode being smaller than that of said fourth grid electrode, said second and fifth grid electrodes being electrically interconnected in said envelope and said third grid electrode and said mesh electrode being electrically interconnected in said envelope, means for impressing a first voltage upon said second and fifth grid electrodes, means for impressing a second voltage which is higher than said first voltage upon said third grid electrode and said mesh electrode and means for applying a third voltage which is lower than said first and second voltages upon said fourth grid electrode.

13. The image pickup tube according to claim 12 wherein said first voltage is equal to 300V, said second voltage is equal to 500V, and said third voltage is equal to about 80V, and said image pickup tube further comprises means for impressing 0 volt upon said cathode electrode and means for impressing about 30V upon said first grid electrode.

* * * * *